US005794333A

United States Patent [19]

Shea

[11] Patent Number: 5,794,333

[45] Date of Patent: Aug. 18, 1998

[54] METHOD AND A UNIT FOR CHANGING A DIE DURING WIRE TERMINATION

[75] Inventor: Patrick J. Shea, El Paso, Tex.

[73] Assignee: UT Automotive Dearborn, Inc., Dearborn, Mich.

[21] Appl. No.: 689,638

[22] Filed: Aug. 13, 1996

[51] Int. Cl.[6] ..... H01R 43/00

[52] U.S. Cl. ..... 29/863; 29/753

[58] Field of Search ..... 29/753, 863, 865, 29/866, 867, 33 M

[56] References Cited

U.S. PATENT DOCUMENTS

| | | | |
|---|---|---|---|
| 3,800,389 | 4/1974 | Brehm et al. . | |
| 4,862,587 | 9/1989 | Nakata et al. | 29/867 |
| 4,907,343 | 3/1990 | Dolan et al. | 29/753 X |
| 5,033,188 | 7/1991 | Polliard et al. | 29/863 X |
| 5,127,159 | 7/1992 | Kudo et al. | 29/863 |
| 5,175,925 | 1/1993 | Grosklos et al. | 29/753 |
| 5,404,634 | 4/1995 | Takeshita et al. | 29/33 M X |
| 5,661,897 | 9/1997 | Kaneda et al. | 29/863 X |

*Primary Examiner*—James F. Coan
*Attorney, Agent, or Firm*—Howard & Howard

[57] ABSTRACT

A method for changing a die for a wire termination machine. The method for use with at least two units. Each unit comprising a reel holder for supporting the reel of terminals and a die connected to the reel holder. The unit being removably attachable to the termination machine. The method of changing the die comprises detaching the first unit from the termination machine and attaching the second unit to the termination machine.

11 Claims, 3 Drawing Sheets

FIG.6
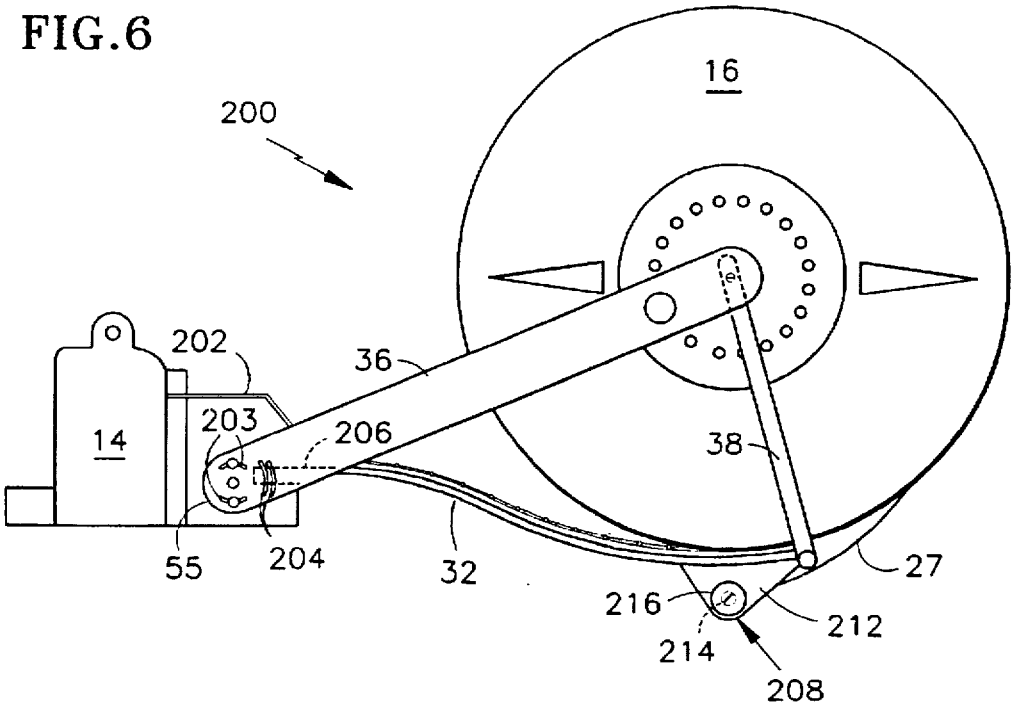
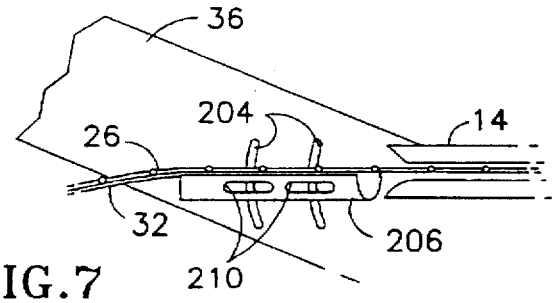
FIG.7
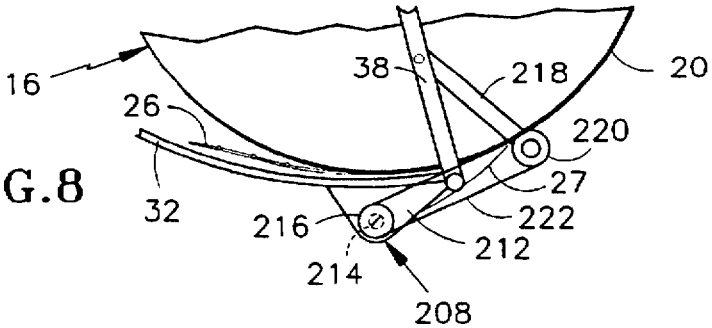
FIG.8

METHOD AND A UNIT FOR CHANGING A DIE DURING WIRE TERMINATION

TECHNICAL FIELD

The present invention relates to wire harness assembly, and more particularly to a method and a unit for changing dies during wire termination.

BACKGROUND OF THE INVENTION

Wire harnesses are large bundles of wire used to interconnect the electrical components of a vehicle to their respective controls and power source. Wire harness assembly of wire harnesses is a complex task. It is often not feasible to fully automate the assembly process due to the number of components and connectors being attached, the variety of harnesses assembled in a single factory, and the degree to which wire harnesses vary to accommodate different option packages within a given model vehicle.

An automated wire termination machine is problematic and includes a movable table, at least one die attached to the table, a cutting machine attached to the table, a payoff device for feeding the wire to the cutting machine, and a reel holder. The cutting machine cuts insulated wire into segments, strips the insulation off the ends of the wire segments. The reel holder includes a beam extending from the table, and a spindle rigidly attached to the beam. Typically, the terminals come in the form of strips on a reel. The reel is rotatably mounted on the spindle. The stripped ends of the wire segments and the strips of terminals are continuously fed to the die. The die crimps the terminal around the stripped end of the wire resulting in an electrically conductive connection between the two elements. The termination machine drops the completed wires into a tray. The wires are transported to an assembly area within the factory where the wires are laid onto a jig, and connected to other electrical components or arms of the wire harness by inserting the terminals into mating connectors.

Each die matches a particular type and/or size of terminal. Throughout the industry the dies must be changed on a regular basis in order to use the termination machine for a different type of terminal. When a die is changed the new die must be set-up by an operator. First, the machine must be turned off and the strip of terminals must be cut upstream of the die, so that the die can be removed from the table. This results in scrap material remaining inside the die. The die is not run in reverse to eject the unused terminals, because reversing the die has a tendancy to damage the terminals. Once the die is removed from the table, the reel must also be removed from the spindle. The old reel is stored on a rack, and the reel of desired terminals is placed on the spindle. Then, the new die is attached to the table. If this new die still has the scrap material inside, the scrap must be feed out of the die.

Since the terminals are delicate and often the stored reels unwind inopportunely the terminals on the free end of the reel may be damaged during handling. Any damaged terminals on the strip are cut off, thus resulting in additional scrap material. At times the end of the strip must also be cut to ensure that the strip is inserted into the die straight. The strip of terminals is then feed into the die. A sample wire is used to verify that the die is working properly. The operator manually crimps a terminal about the sample using the die, if the connection is not up to the necessary quality standards the operator must adjust the machine and reverify the crimp using additional sample wires. Once verified the machine is run in the automated mode, crimping the terminals continuously as needed.

There are several problems with the die change method and the termination machine. First, in a production environment the dies in one factory can be changed thousands of times a day. Since each change results in scrap material the daily number of changes generates a significant amount of scrap material at a significant cost.

Furthermore, significant time is required in order to change dies due to a change requiring loading and unloading of the reels, removal and attachment of the dies, feeding the new strip into the die, and verifying the terminal connection. In a production environment, the time used during a die change is wasted, because the termination machine is not running during these activities, which decreases throughput undesirably. Lastly, by requiring removal of partially used reels of terminals from the holder, inventory control can be more difficult because it is easy to use an unused reel rather than finish a partial reel.

Therefore, an improved method and apparatus are sought for changing dies during wire termination, where the improved method and apparatus decrease the die change time, decrease the terminal damage, and decrease material waste associated with die changing.

SUMMARY OF THE INVENTION

This invention includes a method for changing a die for a wire termination machine. The method is especially suitable for use with at least two units. Each unit comprises a reel holder for supporting the reel of terminals and a die connected to the reel holder. The first unit is removably attachable to the termination machine. The method of changing the die comprises detaching the first unit from the termination machine and attaching the second unit to the termination machine. Since the second die is set up independently of the machine, while the machine is still running, the die change is quick.

The foregoing invention will become more apparent in the following detailed description of the best mode for carrying out the invention and in the accompanying drawings.

BRIEF DESCRIPTION OF THE DRAWING

FIG. 6 is a front view of another embodiment of a unit for changing the die.

FIG. 7 is an enlarged partial left view of the unit of FIG. 6.

FIG. 8 is a partial front view of the unit of FIG. 6 which has been modified.

BEST MODE FOR CARRYING OUT AN EMBODIMENT THE INVENTION

Figure 1:
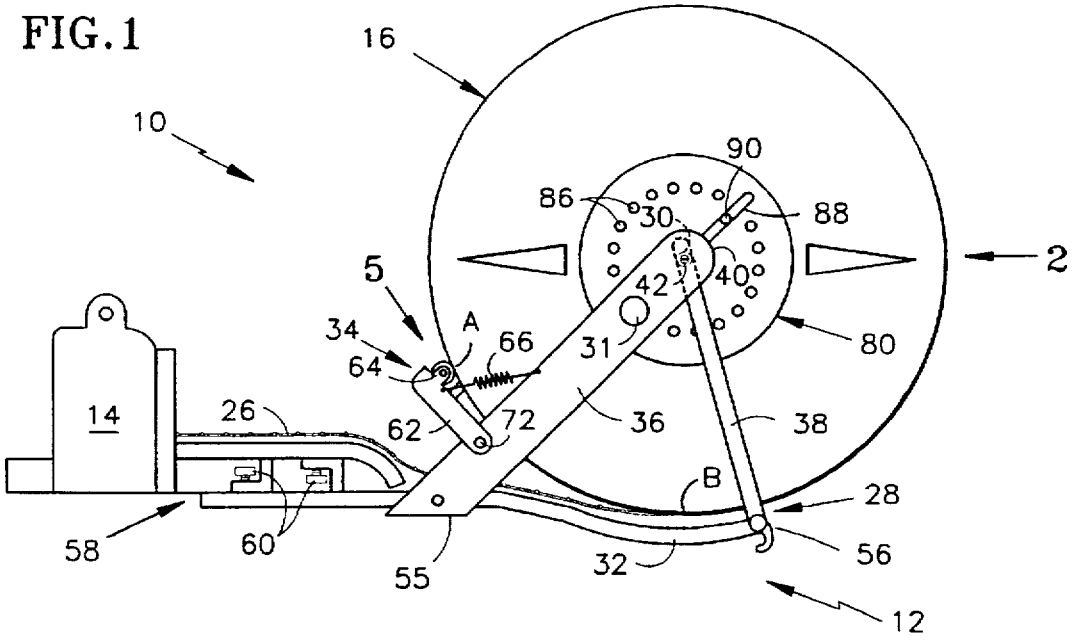
FIG. 1 is a front view of a unit for changing a die of the present invention.

Referring to FIG. 1, a unit 10 for use with a termination machine (not shown) includes a reel holder 12 and a die 14. The reel holder 12 supports a reel of terminals 16.

Figure 2:
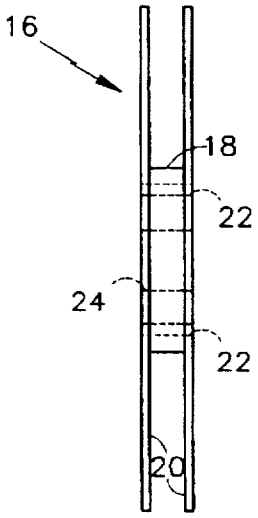
FIG. 2 is a right side view along line 2 of a reel of terminals for use with the unit shown in FIG. 1.
Figure 3:
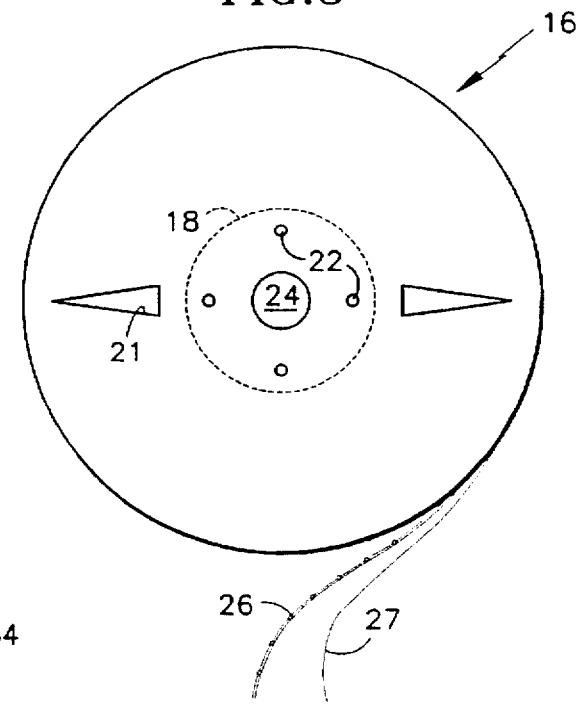
FIG. 3 is a front view of the reel of terminals with the unit removed for clarity.

Referring to FIG. 2 and 3, the reel of terminals 16 includes a tube 18 between two cardboard faces 20. Each cardboard face 20 has two inspection slots 21 therethrough for seeing the interior of the reel 16, a plurality of circumferentially disposed holes 22 and a centrally disposed hole 24. A strip of terminals 26 and a strip of paper 27 are wrapped about the tube 18, so that each layer of terminals 26 is separated by a layer of paper 27. The strip of paper 27 decreases tangling of the terminals 26 on the reels 16.

Figure 4:
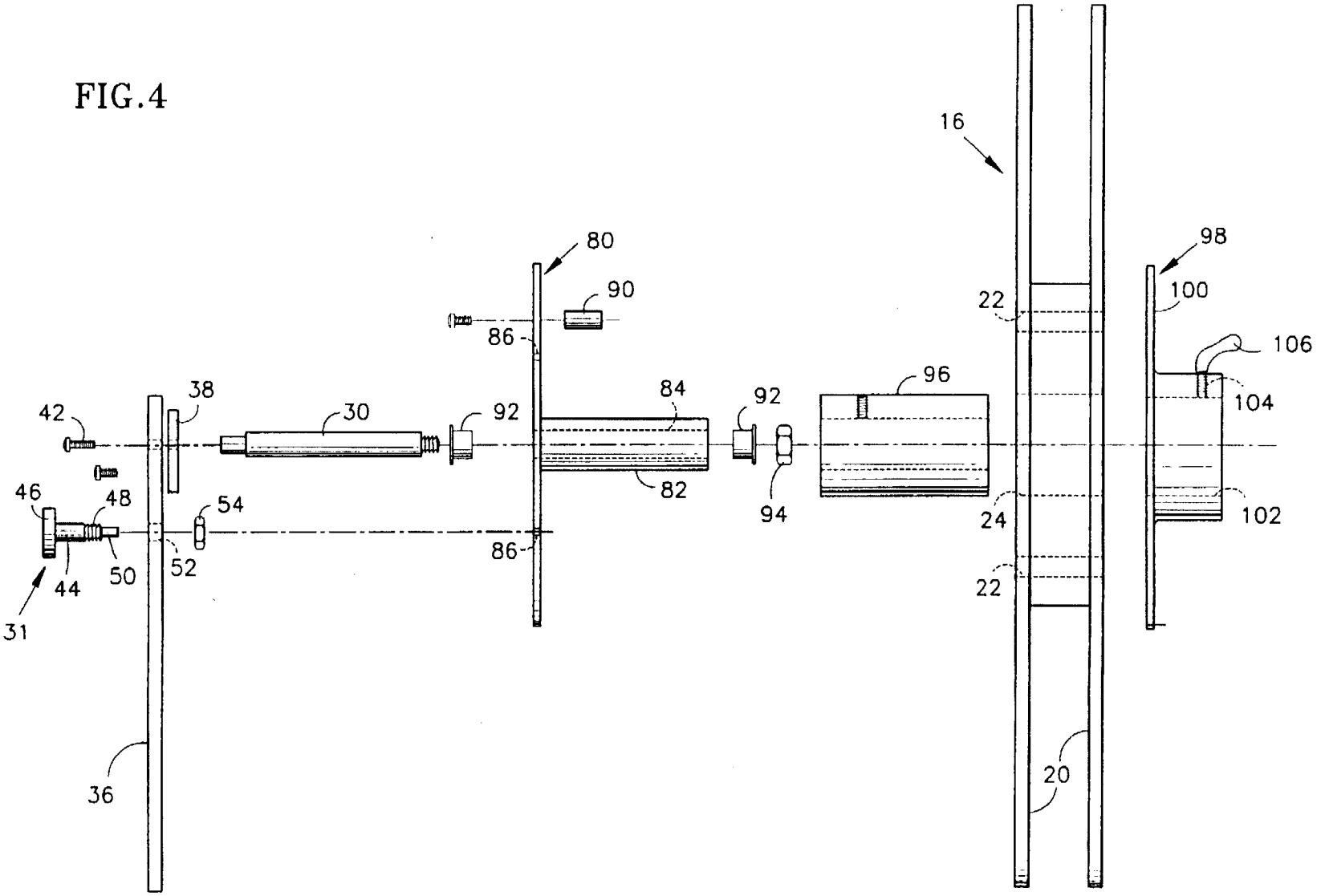
FIG. 4 is an exploded left side view of the unit partially shown, a plate, a reel of terminals, and a locking flange.

Referring to FIG. 1, the reel holder 12 includes frame 28, a rod 30 (as shown in phantom), a locking mechanism 31, a track 32, and a modifier 34. The frame 28 includes a first beam 36 and a second beam 38 connected to one another at the first ends 40 via the rod 30 which extends through various slots and holes (not shown) in the first ends 40 of the beams. The rod 30 is secured in position via a fastener 42. Referring to FIG. 4, the rod 30 extends perpendicular to the beams 36 and 38.

Referring to FIGS. 1 and 4, the locking mechanism 31 includes a spring loaded plunger 44. The plunger 44 has a knob 46 attached to one end, and the other end is stepped so that a threaded portion 48 is separate from an extension 50. The threaded portion 48 extends through a bore 52 in the first support 36, and is secured with a nut 54.

The track 32 is attached to second ends 55 of the first and second beams 36 and 38, respectively. The first end 56 of the track 32 is curved. The curve portion provides a friendly surface for feeding the die 14 the final portion of the strip of terminals 26. The curved portion also serves as a handle. The second end 58 of the track 32 is attached to the die 14 via fasteners 60.

Figure 5:
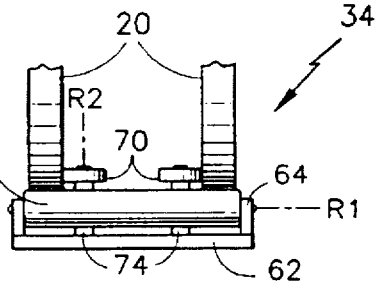
FIG. 5 is a right side view along the line 5 of FIG. 1 of a separator.

Referring to FIGS. 1 and 5, the modifier 34 includes a base 62. The base 62 which has spaced sidewalls 64 attached thereto. The modifier 34 further includes a spring 66, a horizontal roller 68, and a pair of vertical rollers 70.

The lower end of the base 62 is pivotally attached to the first support 36 via a fastener 72. The spring 66 extends between the first support 36 and the base 62. The horizontal roller 68 extends between the two sidewalls 64. The horizontal roller 68 has an axis of rotation R1. The vertical rollers 70 are attached to the base 62 via the posts 74. Each vertical roller 70 has an axis of rotation R2. The spring 66 biases the rollers 68 and 70 against the cardboard faces 20 of the terminal reel 16.

Referring to FIGS. 1 and 4, the unit 10 is used with a circular plate 80 which has a spindle 82 intergrally formed in the center of the plate 80. The spindle 82 extends perpendicular to plate 80. A bore 84 extends through the center of the spindle 82.

The plate 80 further includes a plurality of bores 86, a slot 88, and a pin 90. The bores 86 are disposed circumferentially about the perimeter of the plate 80. The locking mechanism 31 is aligned with the bores 86. The slot 88 extends from between two of the bores 86 toward the center of the plate 80. The pin 90 extends through the slot 88 and is movable within the slot 88 and securable in various positions. The plate is used with two bushings 92, a threaded nut 94, and a cylindrical bushing 96.

The unit 10 is also used with a locking flange 98. The locking flange 98 includes a stepped disk 100 having a centrally disposed bore 102, and a threaded bore 104 perpendicular to the bore 102. The locking flange 98 further includes a threaded screw 106 which is received in the threaded bore 104.

Referring to FIGS. 6 and 7, a modified unit 200 is shown. The unit 200 includes a bracket 202, and the first arm 36 includes curved first slots 203, and curved second slots 204 in close proximnity to the second end 55. The curved slots 203 allow the first beam 36 to be rotated while connected to the bracket 202, thus the unit is adjustable.

The track 32 includes a U-shaped bracket 206 and a take-up device 208. The U-shaped bracket 206 includes a pair of horizontally extending slots 210 in the side walls. When fasteners (not shown) are disposed through the slots 204 and 210, the track is adjustable vertically and horizontally.

The take-up device 208 includes two support walls, represented by the support wall 212. The support walls 212 are spaced from one another and attached to the lower surface of the track 32. A slotted shaft 214 (shown in phantom) is rotatably mounted between the walls 212. A knob 216 is attached to one end of the shaft 214.

Referring to FIG. 8, the take-up device 208 may be driven by the roller 16. The device 208 further includes a spring loaded arm 218, a rubber roller 220, and a belt 222. The arm 218 is attached to the second beam 38 and extends rearwardly therefrom. The r roller 220 is rotatably connected to the free end of the arm 218. The belt 222 encircles the roller 220 and the knob 216. The spring loaded arm 218 is biases the roller 220 against the cardboard faces 20, so that when the reel 16 rotates the roller 218 and via the belt 222 the knob 216 rotates. Thus, the shaft 214 rotates and collects the paper strip 27.

Loading a reel of terminals 16, set-up of the unit 10, and verification will now be discussed. Referring to FIGS. 1 and 4, the rod 18 is disposed through the first and second supports 36 and 38 and attached there to with the bolt 42. The locking mechanism 31 is disposed through the bore 52 and the nut 54 is attached thereto.

Two bushings 92 are inserted into each end of the bore 84 in the plate 80 to assure that the plate 80 rotates smoothly. The plate 80 is disposed upon the rod 30, such that the rod 30 extends into the bore 84. Thus, the plate 80 is rotatably mounted on the rod 30. The threaded nut 94 is engaged with the threaded end of the rod 30 to secure the plate 80 thereto.

The cylindrical bushing 96 is disposed over and attached to the spindle 82. The plate 80 is placed in the locked mode by disposing the extension 50 of the locking mechanism 31 into one of the bores 84 in the plate 80. Thus, the plate 80 is restricted from rotating.

The reel of terminals 16 matching the die 14 is selected and disposed on the bushing 96, so that the bushing 96 extends through the bores 24 of each reel cardboard face 20. The reel is positioned on the bushing 96 so that the pin 90 extends into one of the holes 22 in the closest cardboard face 20. Thus, when the plate 80 rotates the reel 16 rotates.

Referring to FIG. 4, the locking flange 100 is disposed on the rod 30, and secured thereto by tightening the threaded screw 106. The plate 80 is placed in the unlocked mode by removing the extension 50 from the bore 86.

Referring to FIG. 1, the strip of terminals 26 is fed into the die 14. The entire unit 10 is moved to the termination machine (not shown), and the operator bolts the die 14 to the machine. The operator manually verifies the set-up of the unit, by manually crimping a terminal 26 to a sample piece of insulated wire (not shown), with one end stripped. The machine may be run continuously, when the plate 80 rotates, the pin 90 rotates the reel 16 also. Other units are similarly loaded, set-up, verified, removed from the machine and stored.

During operation, the method of changing dies for the most efficiency requires that at least two units 10 be loaded, set-up and verified one unit is running on the machine, while the other is in storage already set-up and verified. When a new die is needed on the machine, the machine is turned off, the first unit is detached from the machine, and the second unit is attached to the termination machine. Since the second unit is already set-up nothing is left to be done while the machine is off and the machine may be turned on again. If the reel ends while the unit is attached to the machine the operator can either can change the reel while the unit is still attached to the machine, or load a new unit already set-up.

Referring to FIGS. 1 and 5, during use the rotation of the reel 16 causes the rollers 68 and 70 to rotate about their axes of rotation R1 and R2 respectively. The placement of the modifier 34 and its geometry causes the rollers 70 to push the cardboard faces 20 apart at point A, which causes the cardboard faces at point B to get closer together. This helps hold the strip of terminals 26 within the reel 16 as close to the die 14 as possible. The less contact the terminals have with the track 32 the less likely the terminals will be damaged. The modifier may be changed so that the rollers push the faces 20 together at Point A so that the faces satisfy the necessary clearances of the machine.

Referring to FIG. 6, during use of the modified unit 200 the reel 16 has a paper strip 27. When the termination machine (not shown) is running the paper strip 27 engages the slotted shaft 214 and is collected by the shaft 214, thus the paper strip does not interfer with the operation of the machine.

Referring to FIG. 8, if the modified take-up is used, the spring loaded arm 218 biases the roller 220 against the cardboard faces 20, so that when the reel 16 rotates the roller 218. Rotation of the roller 218 is transferred to the knob 216 via the belt 222. Thus, the shaft 214 rotates and collects the paper strip 27.

The principal advantage of the present invention is that using the unit and method minimizes die changing time, which results in decreasing the amount of time that the termination machine is not running for a die change. This invention maximizes efficiency by allowing the operator to change dies quickly and allows the operator to set-up as many dies with terminals as needed while the termination machine is running with other units. This method results in significant cost and time savings.

Another advantage of the present invention is that the unit and method minimizes the amount of scrap material associated with changing dies. This results from the reel being mated with one die until it is used up. Thus changing the die does not require cutting the strips to separate the reel from the die. The unit also does not require the ends of a reel to be cut due to damaged terminals. Since the reels are not stored without the unit, the terminals strips are not damaged, thus changing the die does not require the end of the reel to be cut. Mating dies with reels also decreases the concerns with material inventory because all reels must be used up before a new reel is used.

Yet another advantage of the present invention is that damage to the terminals during operation of the machine is minimized. This is due to the reel holder having a track, which supports and protects the terminals as they are fed into the die. Additional advantages include that the frame can be attached to existing dies, the unit is inexpensive to make, the unit is robust, requires minimal training to implement in production, and one frame and track can be used with a number of different types and sizes of reels and termination machines.

While a particular invention has been described with reference to illustrated embodiments, various modifications of the illustrative embodiments, as well as additional embodiments of the invention, will be apparent to persons skilled in the art upon reference to this description without departing from the spirit and scope of the invention, as recited in the claims appended hereto. It is therefore contemplated that the appended claims will cover any such modification or embodiments that fall within the true scope of the invention.

I claim:

1. A method for changing a die for a wire termination machine, said method for use with at least two units having the die and reel holder connected to the die, the reel holder supporting a reel of terminals, said reel including side faces on either side of said terminals, said terminals being fed into the die, wherein said method comprises the steps of:

biasing said side faces of said reel apart at a first point to thereby bias said faces of said reel toward each other at a second point spaced from said first point;

detaching the first unit from the termination machine;

and attaching the second unit to the termination machine.

2. A method for changing a die for a wire termination machine, said method for use with at least first and second units each having the die and a reel holder connected to the die, the reel holder supporting a reel of terminals, said reel including two side faces, one on either side of said reel, said terminals being fed into the die, wherein said method comprises the steps of:

biasing the side faces of the first unit reel apart at a first point to thereby bias the side faces toward each other at a second point so that the terminals do not undesirably exit the reel near the second point;

attaching the first unit to the termination machine;

running the termination machine;

setting up the second unit including biasing the second unit reel side faces apart at a first point to thereby bias the reel side faces toward each other at a second point;

stopping the termination machine;

detaching the first unit from the termination machine;

attaching the second unit to the termination machine; and running the termination machine.

3. A unit for mating a reel of terminals to a die, said unit for use with a termination machine, said unit comprising:

a reel holder for supporting the reel of terminals, including a first beam, a second beam connected to said first beam and a track attached to said first and second beams such that a triangular shape is formed, said reel holder further including a rod connected to and extending perpendicularly from at least one of said beams, said rod rotatably supporting the reel of terminals; and a die connected to said reel holder, the unit being removably attachable to the termination machine.

4. The unit of claim 3, further comprising a take-up reel associated with said reel holder that receives a strip of paper associated with said terminals.

5. The unit of claim 3, wherein said track is adjustable.

6. The unit of claim 3, further comprising a modifier associated with said reel holder that biases side faces of the reel apart from each other at a first point to thereby bias the side faces toward each other at a second point.

7. The unit of claim 6, wherein said modifier includes a pair of rollers that engage inward surfaces on said side faces.

8. A unit for mating a reel of terminals to a die, said unit for use with a termination machine, said unit comprising:

a reel holder for supporting the reel of terminals; said reel holder including a first beam;

a second beam being connected to said first beam;

a track being attached to said first and second beams, such that a triangular shape is formed; and a rod is connected to at least one of said beams, said rod extending perpendicularly therefrom; said rod for rotatably supporting the reel of terminals; and a die attached to said reel holder, the unit being removably attachable to the termination machine.

9. The unit of claim 8, wherein said track is adjustable.

10. The unit of claim 8, further comprising a modifier associated with said reel holder that biases side faces of said reel apart from each other at a first point to thereby bias said side faces toward each other at a second point spaced from said first point.

11. The unit of claim 10, wherein said modifier includes two rollers that each engage an inward surface on said side faces of said reel.

* * * * *